US007927261B2

(12) United States Patent
Fisher

(10) Patent No.: US 7,927,261 B2
(45) Date of Patent: Apr. 19, 2011

(54) BOXER-FLY EXERCISE APPARATUS

(76) Inventor: Justin Fisher, Knoxville, TN (US)

( * ) Notice: Subject to any disclaimer, the term of this patent is extended or adjusted under 35 U.S.C. 154(b) by 0 days.

(21) Appl. No.: 12/776,219

(22) Filed: May 7, 2010

(65) Prior Publication Data

US 2010/0285932 A1 Nov. 11, 2010

Related U.S. Application Data

(60) Provisional application No. 61/176,164, filed on May 7, 2009.

(51) Int. Cl.
*A63B 21/00* (2006.01)
*A63B 21/06* (2006.01)
*A63B 71/00* (2006.01)

(52) U.S. Cl. ..... 482/93; 482/92; 482/139

(58) Field of Classification Search ..... 482/92–100, 482/121, 124, 126, 129, 139
See application file for complete search history.

(56) References Cited

U.S. PATENT DOCUMENTS 1,680,901 A * 8/1928 Rodgers ..... 482/126
2,356,260 A * 8/1944 Maxwell ..... 482/129
2,529,347 A * 11/1950 Ross, Jr. et al. ..... 482/126
3,465,750 A * 9/1969 Schawalder ..... 601/122
3,759,512 A * 9/1973 Yount et al. ..... 482/62
4,720,096 A * 1/1988 Rogers ..... 482/106
5,458,555 A 10/1995 Ko
5,540,640 A 7/1996 Povilaitis
5,613,928 A * 3/1997 Laudone ..... 482/139
5,643,152 A 7/1997 Simonson
5,690,596 A * 11/1997 Parker ..... 482/126
5,707,323 A 1/1998 Simonson
D408,478 S * 4/1999 Kuo ..... D21/673
6,171,221 B1 * 1/2001 Hayduk ..... 482/139
D439,943 S * 4/2001 Webber et al. ..... D21/694
6,485,398 B1 * 11/2002 Kreft ..... 482/94
6,517,469 B1 * 2/2003 Mercier ..... 482/126
6,620,082 B1 9/2003 Siegel
6,689,023 B2 2/2004 Baumler
D563,491 S * 3/2008 Kaplan et al. ..... D21/692
7,789,815 B2 * 9/2010 An ..... 482/126

* cited by examiner

*Primary Examiner* — Steve R Crow
(74) *Attorney, Agent, or Firm* — Pitts & Brittian, P.C.

(57) ABSTRACT

A boxer-fly exercise apparatus, hereinafter Boxer-fly, is provided. The Boxer-fly provides an additional exercise for performing strength training of a user's pectoral muscles. Specifically, the Boxer-fly presents a novel angle for conditioning a user's pectoral muscles derived from the motion performed by a boxer dropping his elbows to block his ribs. Furthermore, the apparatus can be used by any user looking to fully develop their chest muscles.

9 Claims, 2 Drawing Sheets

BOXER-FLY EXERCISE APPARATUS

CROSS-REFERENCE TO RELATED APPLICATIONS

This application claims the benefit of U.S. Provisional Patent Application No. 61/176,164, filed on May 7, 2009.

STATEMENT REGARDING FEDERALLY-SPONSORED RESEARCH OR DEVELOPMENT

Not Applicable

BACKGROUND OF THE INVENTION

1. Field of the Invention

This invention relates to an exercise apparatus. More particularly, this invention relates to an exercise apparatus for strength training.

2. Description of the Related Art

There are many known strength training programs that promote muscle development of an individual's body. Generally, these strength training programs require an individual to perform multiple types of exercises to develop a specific muscle or specific group of muscles. In particular, an individual can perform a specific group of known upper-body exercises to develop the individual's chest muscles. Many of these exercises are performed with the use of weight training equipment, such as a conventional weight machine, which provides resistance to the individual's movement. These conventional weight machines only work the muscles from a limited number of angles that are standard to weight training. Hereinafter, an angle is defined by the individual's motion utilized in the exercise and the direction of the resistance thereto. Unfortunately, repetitively performing these strength training exercises from a limited number of angles ultimately results in stunting an individual's muscle growth and limiting their overall muscle development results. To encourage muscle growth and development, a person will generally perform multiple training exercises on multiple conventional weight machines to exercise their muscles from different angles. Exercise from each of different angles further enhances muscle growth and overall muscle development results, but additional novel angles for strength training exercises are desired.

BRIEF SUMMARY OF THE INVENTION

A boxer-fly exercise apparatus, hereinafter Boxer-fly, is described herein and illustrated in the accompanying figures. The Boxer-fly is a piece of weight training equipment configured to guide an user's arms rotating about an axis defined by the user's hands and providing resistance thereto. Specifically, the Boxer-fly provides resistance to inward rotation of the user's arms and alternatively outward rotation of a user's arms. In one embodiment, the Boxer-fly provides resistance to rotation of the user's arms between first position and a second position. The first position is defined by placement of the user's hands above the transverse plane proximate the user's midsagittal plane and placement of the user's elbows in an outward position that is substantially parallel to the ground. The second position is defined by the placement of the user's elbows in a position parallel to the user's midsagittal plane while maintaining the user's hands above the transverse plane proximate the user's midsagittal plane. The Boxer-fly provides for additional novel angles for a strength training exercise of a user's pectoral muscles by rotation of the user's arms from the first position to the second position.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A boxer-fly exercise apparatus 10, hereinafter Boxer-fly, is described in detail herein and illustrated in the accompanying figures. The Boxer-fly 10 provides an additional exercise for performing strength training of a user's pectoral muscles. Specifically, the Boxer-fly 10 presents a novel angle for conditioning a user's pectoral muscles derived from the motion performed by a boxer dropping his elbows to block his ribs. Furthermore, the apparatus can be used by any user looking to fully develop their chest muscles.

Figure 1:
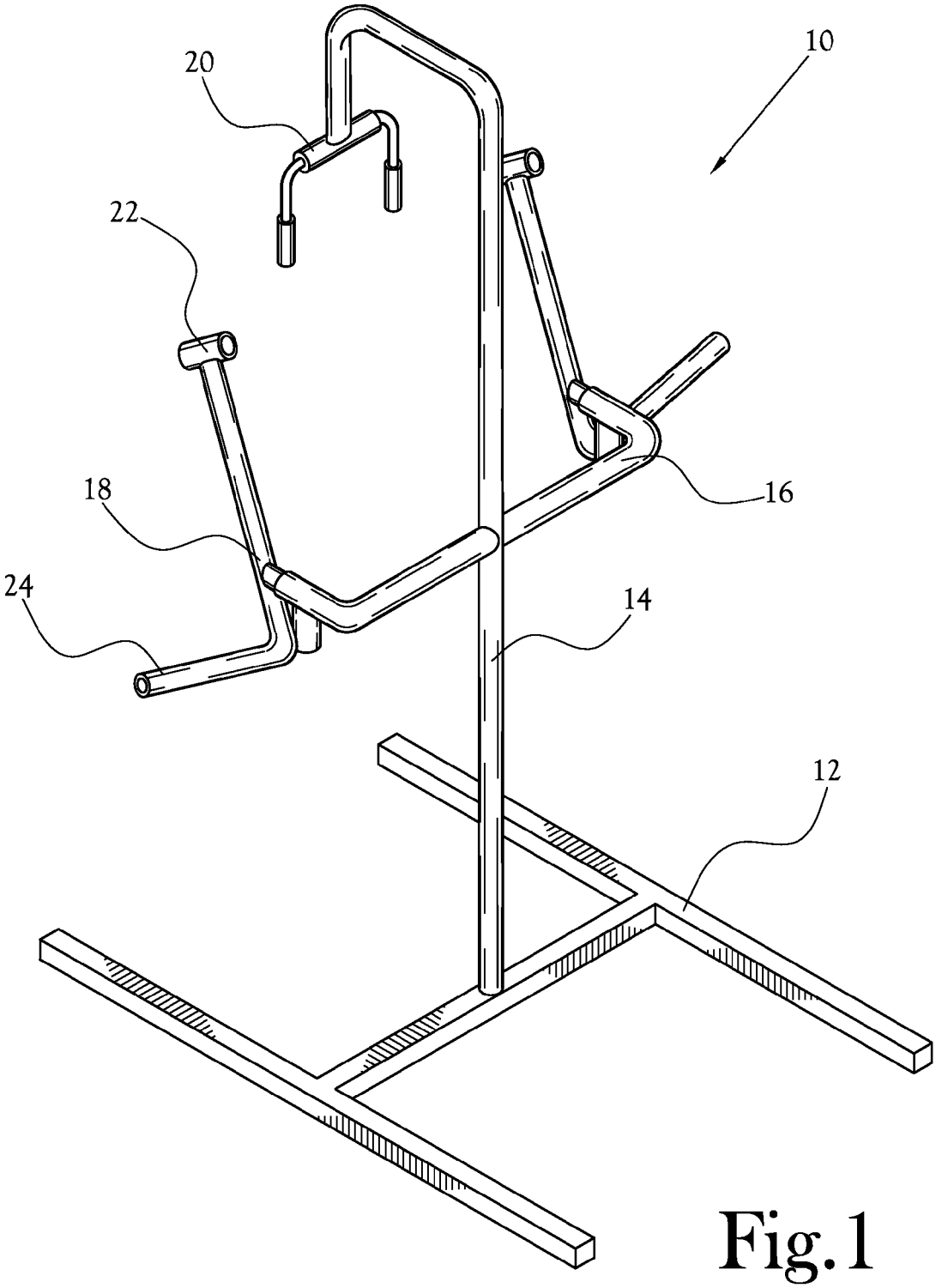
FIG. 1 is a representation of one embodiment of a boxer-fly exercise apparatus.

FIG. 1 illustrates one embodiment of the Boxer-fly 10 in accordance with the one aspect of the present invention. The Boxer-fly 10 is configured to guide a user's arms about an axis defined by the user's hands and providing resistance thereto. Specifically, the Boxer-fly 10 provides resistance to inward rotation of the user's elbows and alternatively provides resistance to outward rotation of a user's elbows. In one embodiment the Boxer-fly 10 provides resistance to inward rotation between first position and a second position. The first position is defined by placement of the user's hands above the transverse plane proximate the user's midsagittal plane and placement of the user's forearms in an outward position that is substantially parallel to the ground. The second position is defined by the placement of the user's forearms in a position substantially parallel to the user's midsagittal plane while maintaining the user's hands above the transverse plane proximate the user's midsagittal plane.

More specifically, FIG. 1 illustrates one embodiment of the Boxer-fly 10 comprising tubular piping configured for use with conventional weights. One suitable selection for construction of one embodiment of the Boxer-fly 10 is 1.5 inch steel piping. The Boxer-fly 10 includes a base member 12, a vertical member 14, a traverse member 16, resistance member 18, and a hand grip 20. In the illustrated embodiment, the base member 12 is a horizontal member that supports and provides stability for the vertical member 14. The vertical member 14 is configured such that the vertical member 14 is located along the midsagittal plane of the user when being used. In the illustrated embodiment, the vertical member 14 supports a transverse member 16 such that the transverse member 16 is positioned in accordance with the transverse plane of the user. The transverse member 16 extends along the transverse plane to a position approximately the span of the user's elbows when extended to an outward position that is substantially parallel to the ground. The vertical member 14 also supports the hand grip 20 and is configured for placement of the user's hands above the user's transverse plane proximate the user's midsagittal plane. More specifically, in the illustrated embodiment the hand grip 20 is located proximate the user's head. The hand grip 20 provides a fixed axis about which the user's elbows rotate. The resistance member 18 is pivotally supported by the transverse member 16. More specifically, the resistance member 18 is defined by a contact member 22 and a load member 24. The contact member 22 and load member 24 cooperate such that the resistance member 18 is pivotally supported by the transverse member 16. Generally, the contact member 22 is the portion of the Boxer-fly 10 which engages the arms of the user. Specifically, the contact member 22 engages proximate the user's elbows when the user is in the first position. The load members 24 are configured to receive weights and provide resistance to rotation of the resistance members 18 by the user. Specifically, the load members 24 provide resistance to displacement of the contact members 22 to the second position wherein the user's elbows are in a position parallel to the user's midsagittal plane. As depicted, the resistance members are biased towards a resting position correlating to the first position.

Figure 4:
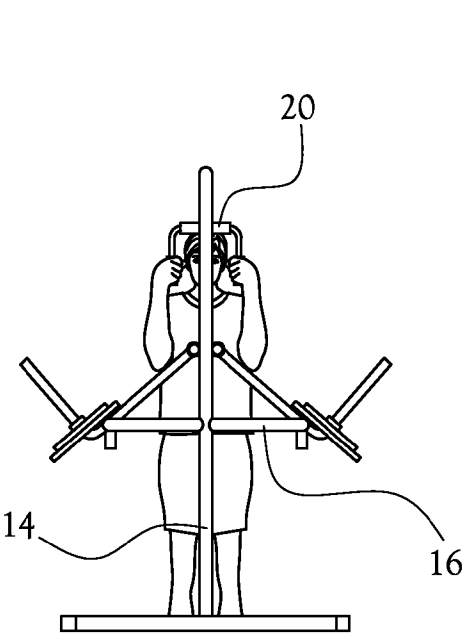
FIG. 4 is a representation of one embodiment of a boxer-fly exercise apparatus and further depicts a user in a second position.
Figure 3:
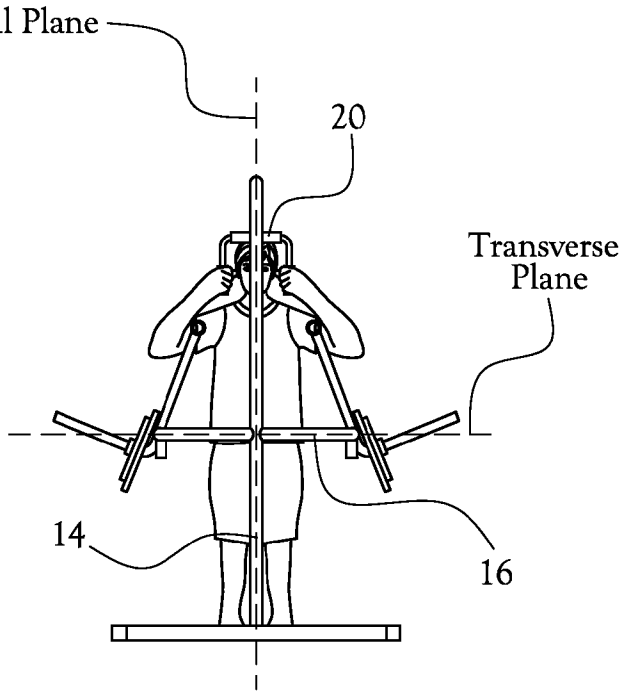
FIG. 3 is a representation of one embodiment of a boxer-fly exercise apparatus rotating the boxer-fly exercise apparatus between a first position and a second position.
Figure 2:
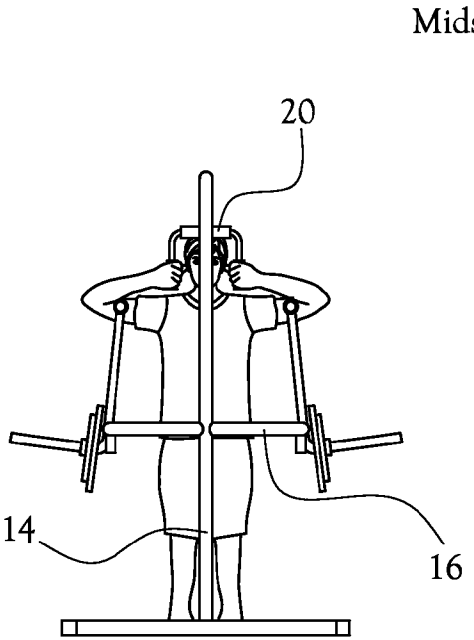
FIG. 2 is a representation of one embodiment of a boxer-fly exercise apparatus and further depicts a user in a first position.

FIGS. 2-4 illustrate one embodiment of a user performing resistance training on one embodiment of the Boxer-fly 10. In the illustrated embodiment, the user takes a wide stance approximately the distance of the user's shoulders. The user approaches the Boxer-fly 10 such that the vertical member 14 is located along the midsagittal plane of the user and the transverse member is proximate the transverse plane of the user. The user engages the hand grip 20 such that the user's hands are proximate to the user's head and provides a fixed axis for rotation. As depicted in FIG. 2, the user engages the Boxer-fly 10 at a first position wherein the user's elbows are in an outward position that is substantially parallel to the ground. The illustrated embodiment of the Boxer-fly 10 is configured for rotation of the user's arms between first position and a second position. FIG. 4 illustrates the second position wherein the user's elbows are rotated into a position parallel to the user's midsagittal plane while maintaining the user's hands at the fixed axis.

From the foregoing description, those skilled in the art will recognize that the Boxer-fly apparatus and method for providing strength training of a user's pectoral muscles offering advantages over the prior art has been provided. More specifically, the Boxer-fly and method provides a novel angle for conditioning a user's pectoral muscles. The Boxer-fly can be used by anyone who is looking to correctly develop their chest muscles.

While the present invention has been illustrated by description of several embodiments and described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An boxer-fly exercise apparatus comprising:

a vertical member positioned so as to be generally located along the midsagittal plane of a user's body;

a hand grip supported by said vertical member, said hand grip comprising a pair of stationary gripping portions, each of said griping portions adapted for being gripped by one hand of the user and positioned so as to be generally located above the transverse plane of the user's body and proximate the midsagittal plane of the user's body;

a first resistance member comprising:

a contact member having a proximate end and a distal end, said proximate end is pivotally supported by said vertical member at a pivot point, said distal end of said contact member extending to a position that engages the user proximate the user's elbow when the user's forearms are placed in an outward position that is substantially parallel to the ground, said contact member adapted for rotation about said pivot point such that the user's forearms are rotated into a substantially parallel position to the user's midsagittal plane; and a load member located proximate to said pivot point, said load member opposing rotation of said contact member about said pivot point toward said vertical column and biasing said first resistance member towards a resting position.

2. The boxer fly of claim 1 further comprising a second resistance member comprising:

a contact member having a proximate end and a distal end, said proximate end is pivotally supported by said vertical member at a pivot point, said distal end of said contact member extending to a position that engages the user proximate the user's elbow when the user's forearms are placed in an outward position that is substantially parallel to the ground, said contact member adapted for rotation about said pivot point such that the user's forearms are rotated into a substantially parallel position to the user's midsagittal plane; and a load member located proximate to said pivot point, said load member opposing rotation of said contact member about said pivot point toward said vertical column and biasing said second resistance member towards a resting position.

3. The boxer fly of claim 1 wherein said load member is configured to receive weights that provide opposition to rotation of said first resistance member and biasing said first resistance member towards a resting position.

4. The boxer fly of claim 1 wherein said gripping portions are substantially parallel with the user's midsagittal plane and the user's hands engage the gripping portions with the user's knuckles being substantially vertically aligned.

5. The boxer fly of claim 1 further comprising a transverse member supported by said vertical member and positioned proximate the transverse plane of the user's body, said transverse member directly pivotally supporting said contact member.

6. An boxer-fly exercise apparatus comprising:

a vertical member positioned so as to be generally located along the midsagittal plane of a user's body;

a hand grip supported by said vertical member, said hand grip comprising a pair of stationary gripping portions, each of said griping portions adapted for being gripped by one hand of the user and positioned so as to be generally located above the transverse plane of the user's body and proximate the midsagittal plane of the user's body;

a transverse member supported by said vertical member and positioned proximate the transverse plane of the user's body;

a first resistance member comprising:

a contact member having a proximate end and a distal end, said proximate end is pivotally connected to said transverse member at a pivot point, said distal end of said contact member extending to a position that engages the user proximate the user's elbow when the user's forearms are placed in an outward position that is substantially parallel to the ground, said contact member adapted for rotation about said pivot point such that the user's forearms are rotated into a substantially parallel position to the user's midsagittal plane; and a load member located proximate to said pivot point, said load member opposing rotation of said contact member about said pivot point toward said vertical column and biasing said resistance member towards a resting position.

7. The boxer fly of claim 6 further comprising a second resistance member comprising:

a contact member having a proximate end and a distal end, said proximate end is pivotally supported by said vertical member at a pivot point, said distal end of said contact member extending to a position that engages the user proximate the user's elbow when the user's forearms are placed in an outward position that is substantially parallel to the ground, said contact member adapted for rotation about said pivot point such that the user's forearms are rotated into a substantially parallel position to the user's midsagittal plane; and a load member located proximate to said pivot point, said load member opposing rotation of said contact member about said pivot point toward said vertical column and biasing said second resistance member towards a resting position.

8. The boxer fly of claim 6 wherein said load member is configured to receive weights that provide opposition to rotation of said first resistance member and biasing said first resistance member towards a resting position.

9. The boxer fly of claim 6 wherein said gripping portions are substantially parallel with the user's midsagittal plane and the user's hands engage the gripping portions with the user's knuckles being substantially vertically aligned.

* * * * *